US006857512B2

(12) United States Patent
Scicluna et al.

(10) Patent No.: US 6,857,512 B2
(45) Date of Patent: Feb. 22, 2005

(54) SELECTIVELY ROTATABLE HANDLE ASSEMBLY FOR TOWABLE LUGGAGE

(75) Inventors: Paul V. Scicluna, Penndel, PA (US); Timm J. Fenton, Lebanon, NJ (US)

(73) Assignee: Tumi, Inc., South Plainfield, NJ (US)

( * ) Notice: Subject to any disclaimer, the term of this patent is extended or adjusted under 35 U.S.C. 154(b) by 28 days.

(21) Appl. No.: 10/392,522

(22) Filed: Mar. 20, 2003

(65) Prior Publication Data

US 2004/0182665 A1 Sep. 23, 2004

(51) Int. Cl.[7] ..... A45C 13/26; A45C 5/14
(52) U.S. Cl. ..... 190/115; 190/39; 16/113.1
(58) Field of Search ..... 190/39, 115; 16/113.1, 16/114, 114.1

(56) References Cited

U.S. PATENT DOCUMENTS

| | | | | | |
|---|---|---|---|---|---|
| 1,616,632 | A | * | 2/1927 | Mastrontonio | 280/79.2 |
| 4,062,429 | A | * | 12/1977 | Tabor et al. | 190/18 A |
| 5,000,467 | A | * | 3/1991 | Becca | 280/47.24 |
| 5,265,307 | A | | 11/1993 | Hull et al. | 16/114 |
| 5,339,934 | A | * | 8/1994 | Liang | 190/18 A |
| 5,353,900 | A | * | 10/1994 | Stilley | 190/18 A |
| 5,464,080 | A | | 11/1995 | Liang | 190/18 |
| 5,706,921 | A | * | 1/1998 | Wang | 190/115 |
| 5,806,143 | A | | 9/1998 | Tsai | 16/115 |
| 5,890,570 | A | | 4/1999 | Sadow | 190/18 |
| 6,302,250 | B1 | * | 10/2001 | Sadow et al. | 190/18 A |
| 6,317,924 | B1 | | 11/2001 | Gallagher | 16/114 |
| 6,357,080 | B1 | | 3/2002 | Tsai | 16/113.1 |
| 6,434,790 | B1 | | 8/2002 | Chen | 16/113.1 |
| 6,470,533 | B1 | | 10/2002 | Comstock | 16/445 |
| 6,508,344 | B1 | | 1/2003 | Lu | 190/115 |
| 6,530,459 | B1 | * | 3/2003 | Lu | 190/115 |
| 6,591,951 | B1 | * | 7/2003 | Chen | 190/115 |
| 6,651,992 | B1 | * | 11/2003 | Smith, Sr. | 280/47.26 |
| 2002/0144874 | A1 | | 10/2002 | Nykoluk et al. | |
| 2003/0079950 | A1 | * | 5/2003 | Lin et al. | |
| 2003/0132080 | A1 | * | 7/2003 | Dababneh | |

FOREIGN PATENT DOCUMENTS

| | | | | |
|---|---|---|---|---|
| DE | 3636064 A1 | * | 4/1988 | A45C/5/14 |
| FR | 2371178 | * | 7/1978 | |
| WO | 0152687 | | 7/2001 | |

* cited by examiner

*Primary Examiner*—Sue A. Weaver
(74) *Attorney, Agent, or Firm*—Baker Botts LLP

(57) ABSTRACT

A handle assembly for towable, wheeled luggage includes an axially elongated tubular member, which is extendably and retractably attachable at one end to the luggage, and a handgrip assembly rotatably mounted on the free end of the tubular member. A slidable collar assembly surrounds the rotational dividing line between the handgrip assembly and the tubular member and is axially movable relative thereto to permit selective rotation and locking of the handgrip assembly relative to the tubular member. The handgrip assembly may have a P-shaped configuration which is rotatable to position the loop portion of the P-shaped assembly to one side or the other to accommodate lefthanded and righthanded towing of the luggage.

13 Claims, 5 Drawing Sheets

SELECTIVELY ROTATABLE HANDLE ASSEMBLY FOR TOWABLE LUGGAGE

BACKGROUND OF THE INVENTION

1. The Field of the Invention

The present invention concerns handles for towable, wheeled luggage and, more particularly, a selectively rotatable handle assembly which provides ergonomically improved towing of such luggage items.

2. The Related Art

FIG. 1 depicts a conventional piece of towable luggage 10, which typically includes a pair of wheels 12 at its lower end and an extensible handle 14 comprising of a pair of telescopic tubes 16 that are joined at their upper ends by a static transverse handgrip 18. In use, the handle 14 is extended and the luggage 10 is tilted and towed in a direction generally perpendicular to the axis of the wheels 12. While generally satisfactory, this conventional handle construction requires the user to grasp the handgrip 18 with his/her wrist rotated nearly transverse to the towing direction. Such a position of the user's hand is uncomfortable, particularly with large or heavy luggage or where the luggage must be towed for long distances. Also, the static transverse handgrip 18 often does not position the luggage sufficient far from the user's body to prevent the user's feet from colliding with the luggage when the user is towing the luggage.

Numerous efforts have been made in the prior art to provide more ergonomically satisfactory handles, as evidenced, for example, by U.S. Pat. Nos. 5,265,307, 5,464,080, 5,890,570, 6,317,924, 6,434,790and 6,470,533 and WO 01/52687. None of these earlier handles, however, fully meets the needs of the art, especially for towable, wheeled luggage having telescopically extensible handles. In particular, it is desirable to provide a handle assembly which facilitates extension and retraction of the handle, while concurrently permitting freedom of positioning of the handgrip portion to maximize user comfort and convenience in towing the luggage. It is also desirable that the handle assembly resist tipping over of the luggage upon encountering an obstacle, e.g., a curb, while being towed.

SUMMARY OF THE INVENTION

The foregoing and other needs of the prior art are met by the present invention, which provides a handle assembly for towable, wheeled luggage comprising an elongated tubular member adapted to be connected at one end to a piece of luggage, a handgrip assembly rotatably mounted on the other, free end of the tubular member, and a collar assembly mounted at the juncture between the tubular member and the handgrip assembly. The handgrip assembly includes a base portion adjacent to the upper end of the tubular member and a handgrip portion. The collar assembly includes a collar slidably mounted on the base portion of the handgrip assembly for movement in the direction of the axis of elongation of the tubular member between a first axial position, at which the collar is located on the handgrip assembly side of the dividing line between the handgrip assembly and the tubular member and permits rotation of the handgrip assembly relative to the tubular member, and a second axial position, at which the collar overlies the dividing line and prevents rotation of the handgrip assembly relative to the tubular member.

In accordance with the invention, the handgrip portion of the handgrip assembly is preferably offset, or eccentric, to the tubular member. Advantageously, the handgrip portion may be generally P-shaped, with the stem of the P forming the base portion of the assembly and the loop of the P forming the handgrip portion. By movement of the collar between the first and second axial positions, the eccentric handgrip portion may be selectively rotated to and locked in a plurality of rotational positions relative to the tubular member.

Such positions may include a left hand towing position, at which the eccentric handgrip portion extends towards the left side of the luggage (as viewed from the rear), and a 180°-spaced right hand towing position, at which the eccentric handgrip portion extends towards the right side of the luggage. To facilitate the rotation of the handgrip assembly to and locking in such left hand and right hand towing positions, the tubular member, the base portion of the handgrip assembly, and the slidable collar suitably have elliptical transverse cross sections whose major dimensions extend substantially perpendicular to the towing direction, i.e., in the direction of the axis of rotation of the luggage wheels.

In another embodiment, provision may be made to lock the handgrip assembly with the handgrip portion extending in the towing direction. With the aforementioned elliptical cross-section configuration of the tubular member, the base portion, and the collar, this may be accomplished by providing axial slots in the upper end of the tubular member which extend in the direction of the minor dimension thereof and are spaced apart in the direction of the major dimension thereof by a distance corresponding to the minor dimension of the cross section of the collar.

Preferably, the tubular member comprises a telescopically extendable and retractable member (which may include multiple sections). A locking mechanism is provided to releasably control the extension and retraction thereof, and a pushbutton located on the handgrip portion of the handgrip assembly allows the user to operate the locking mechanism as desired.

In accordance with a further feature of the invention, the collar assembly includes a transition member fixedly mounted to the tubular member at its upper end. The slidable collar, when in the second, or locking, axial position, axially overlaps the transition member. To better hold the collar in the locking position, a locking taper or one or more raised regions may be provided on one or both of the opposed surfaces of the collar and the transition member. Preferably, a circumferential flange is provided at the upper end of the collar to serve as a finger grip for facilitating movement of the collar between the locking and unlocking axial positions.

BRIEF DESCRIPTION OF THE DRAWINGS

For a better understanding of the invention, reference may be made to the following description of exemplary embodiments thereof, taken in conjunction with the accompanying drawings, in which.

DETAILED DESCRIPTION OF EXEMPLARY EMBODIMENTS OF THE INVENTION

Figure 1:
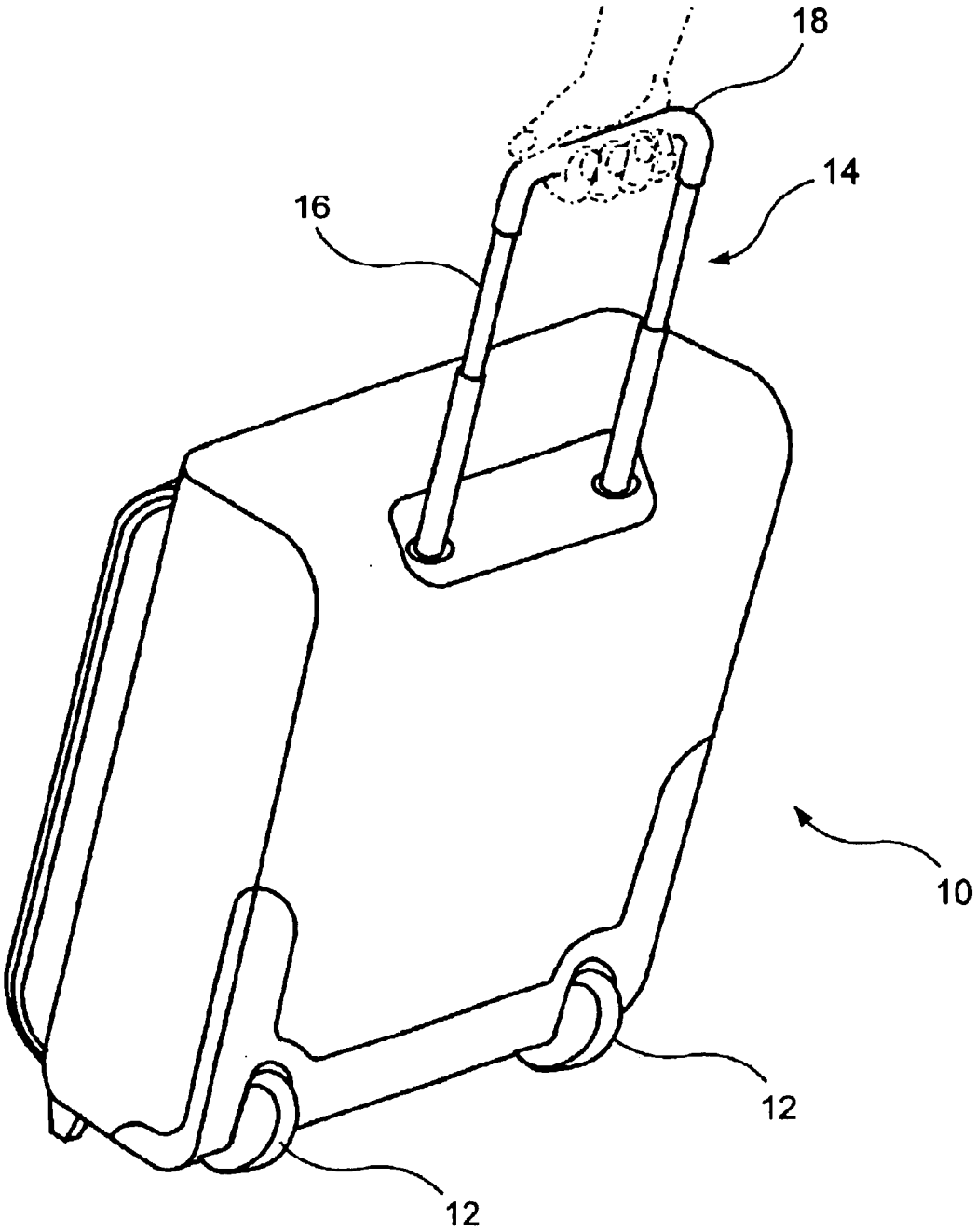
FIG. 1 PRIOR ART
FIG. 1 is a rear perspective view of a conventional towable, wheeled luggage item having a telescopic towing handle.
Figure 3:
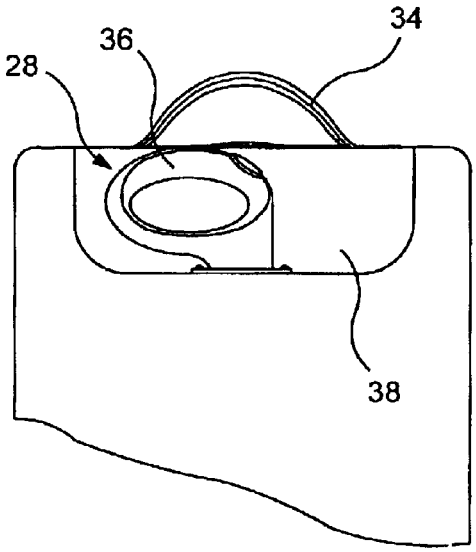
FIG. 3 is a partial rear view similar to FIG. 2, but showing the handle assembly in the retracted position.
Figure 2:
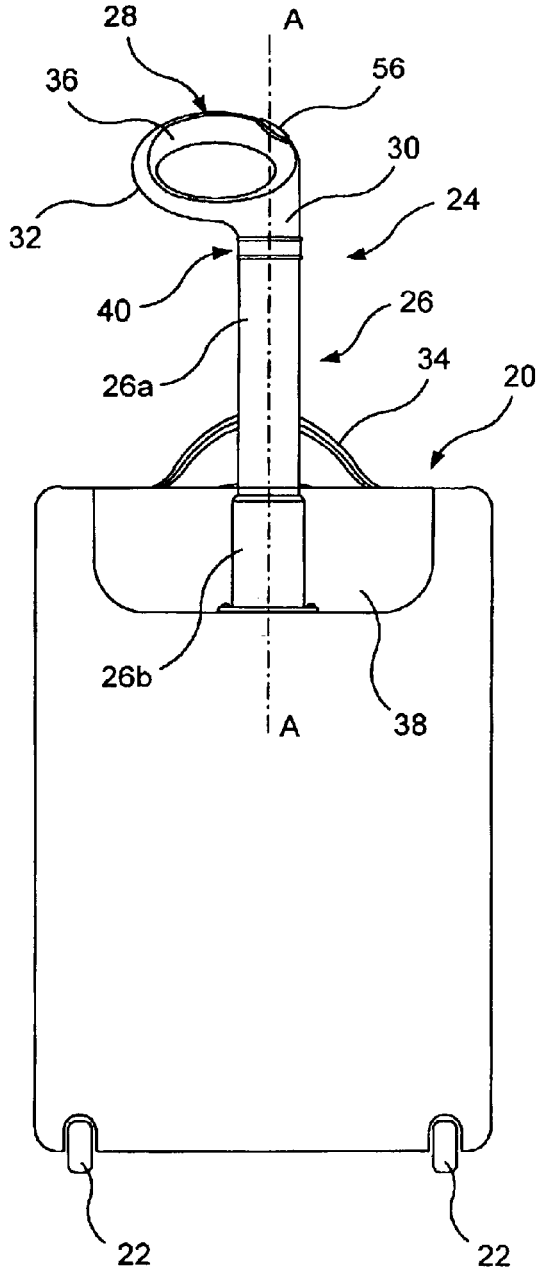
FIG. 2 is a rear view of a towable, wheeled luggage item showing one embodiment of a selectively rotatable handle assembly in accordance with the invention in the extended position, with the handgrip rotated to the left hand towing position.

In the embodiment of FIG. 2, a towable, wheeled luggage item 20 includes the usual wheels 22 at the lower end thereof and an extendable-retractable handle assembly 24 at the upper end thereof. The handle assembly 24 comprises an elongated tubular member 26 which is retractable within and extendable from the body of the luggage item 20. The extended and retracted positions of the handle assembly 24 are shown in FIGS. 2 and 3, respectively. To that end, the tubular member may comprise a plurality of telescopic sections 26*a*, 26*b*, etc., which construction is known per se in the art.

At its upper, or free, end, the handle assembly 24 includes a handgrip assembly 28 which, as described more fully hereinbelow, is selectively rotatable relative to the tubular member 26 about the axis of elongation A—A thereof. The handgrip assembly 28 itself comprises two portions: a base portion 30 and a handgrip portion 32. The luggage item 20 may also be provided with a conventional top carry handle 34 for handling the luggage when it is not being towed.

Figure 4:
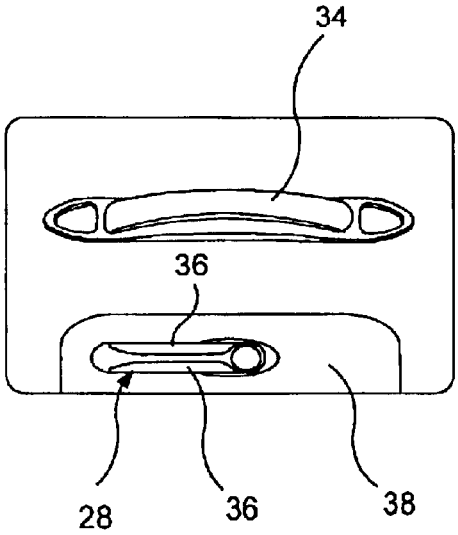
FIG. 4 is a top view of the embodiment of FIG. 2.
Figure 6:
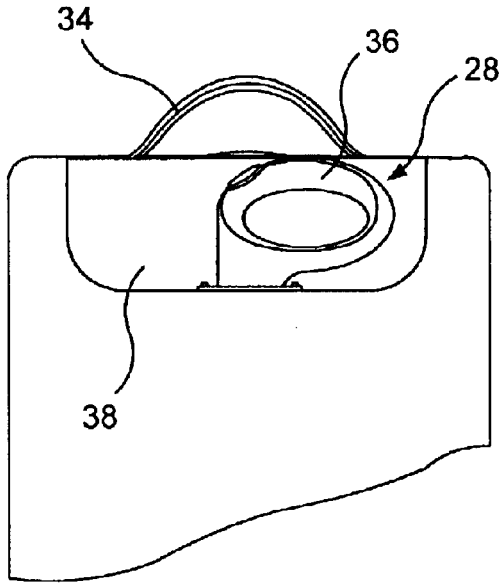
FIG. 6 is a partial rear view similar to FIG. 5, but showing the handle in the retracted position.
Figure 5:
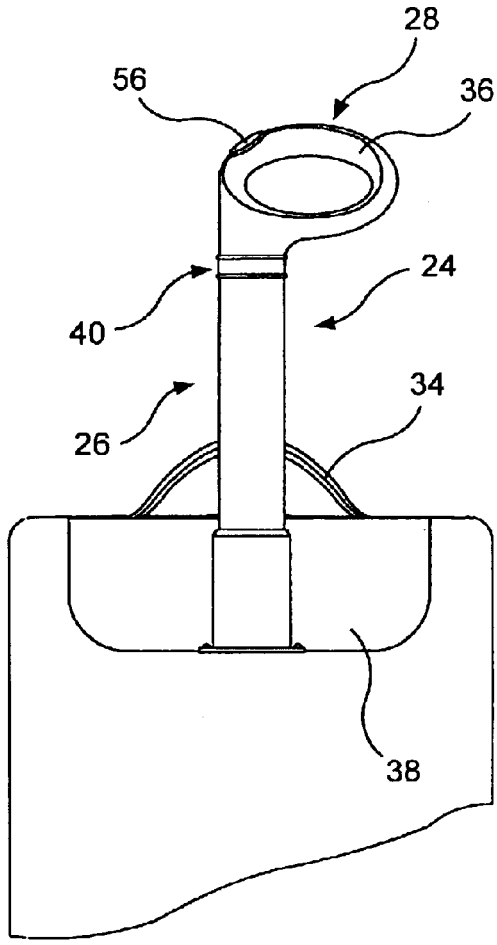
FIG. 5 is a partial rear view of the embodiment of FIG. 2, but showing the handgrip rotated to the right hand towing position.
Figure 7:
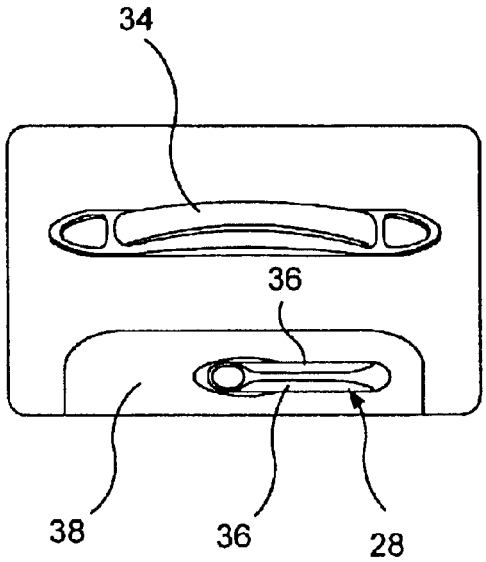
FIG. 7 is a top view of the embodiment of FIG. 5.

In accordance with the invention, the handgrip portion 32 of the handgrip assembly 28 is preferably configured so as to be offset, or eccentric, to the axis A—A of the tubular member 26. In a preferred embodiment, the handgrip assembly 28 has a generally P-shaped configuration, with the base portion 30 forming the stem of the P-shaped configuration and the handgrip portion 32 forming the loop of the P-shaped configuration. Such a P-shaped configuration of the handle assembly 28 conforms comfortably to the user's hand and also provides either a left hand towing position, shown in FIGS. 2–4, or a right hand towing position, shown in FIGS. 5–7. As may be seen, in either position the handgrip portion 32 extends transversely to the side of the tubular member 26 in a direction generally perpendicular to the towing direction, i.e., parallel to the axis of rotation of the wheels 22. This positions the handgrip portion 32 closer to the left side or the right side, respectively, of the luggage item 20, as viewed from the rear in FIGS. 2 and 5. As a consequence, the luggage item 20 is spaced farther from the user's body during towing, where it is less likely to interfere with the user's feet. For further comfort and gripping security, the handgrip portion 32 may be formed with a resilient grip material 36 on those portions coming into contact with the user's hand. It will be understood that other eccentric configurations of the handgrip assembly 28 could be provided to a similar effect.

Preferably, the handle assembly 24 is extendable or retractable in either rotational position of the handgrip assembly 28. As shown in FIGS. 2–7, therefore, the luggage item 20 is preferably provided at the juncture of its upper and rear surfaces with a recess 38 of a transverse and axial extent large enough to receive the hand grip assembly 28 in either the left hand or the right hand towing position. This construction allows the handle assembly 24 to be readily extended or contracted in either rotational position of the handgrip assembly 28 and protects the handgrip assembly 28 against damage when in the retracted position.

Figure 8:
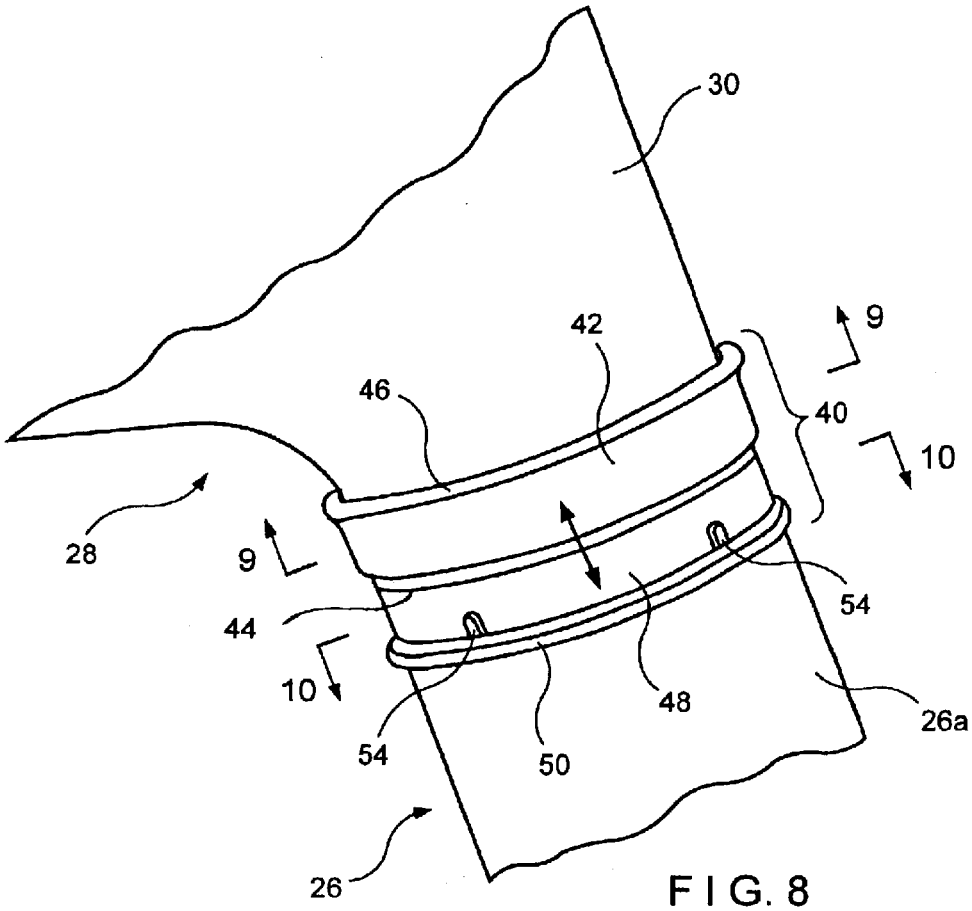
FIG. 8 is a detail perspective view of one embodiment of a slidable locking collar assembly in accordance with the invention for permitting selective rotation of the handgrip assembly of the handle assembly.

In accordance with a feature of the invention, the selective rotation of the handgrip assembly 28 to either the left hand or the right hand towing position, and the locking of such assembly in either position, is controlled by a manually operated sliding collar assembly 40. The structure of the collar assembly 40 is shown in detail in FIGS. 8–10.

As there shown, the collar assembly 40 includes a collar 42 slidably mounted in surrounding relation to the outer circumferential surface of the base portion 30 of the handgrip assembly 28. The collar 42 is slidable axially of the tubular member 26 and base portion 30, as indicated by the arrow in FIG. 8, between a first axial position, shown in FIG. 8, in which the collar 42 is located above the rotational dividing line 44 between the base portion 30 of the handgrip assembly 28 and the upper end of the tubular member 26, and a second axial position, shown in FIGS. 2 and 5, in which the collar 42 axially overlies the dividing line 44 and overlaps the upper end of the tubular member 26. When the collar 42 is in the first axial position, the handgrip assembly 28 is free to rotate along the dividing line 44 about the axis of elongation of the tubular member 26, and when the collar 42 is in the second axial position, the handgrip assembly 28 is locked against rotation relative to the tubular member 26. At its upper end, the collar 42 is preferably formed with a circumferential flange 46 which serves as a finger grip to enable the user to slide the collar between the first and second axial positions.

The upper end of the tubular member 26 adjacent to the dividing line 44 is preferably covered by a circumferential transition member 48 attached to the tubular member 26. The collar 42 slides axially over the transition member 48. A circumferential flange 50 may be formed at the lower end of the transition member 48 against which the collar 42 rests when in the second axial position. Alternatively, the outer wall of the tubular member 26 may be thickened or deformed outwardly to form a stop for the collar 42.

Figure 9:
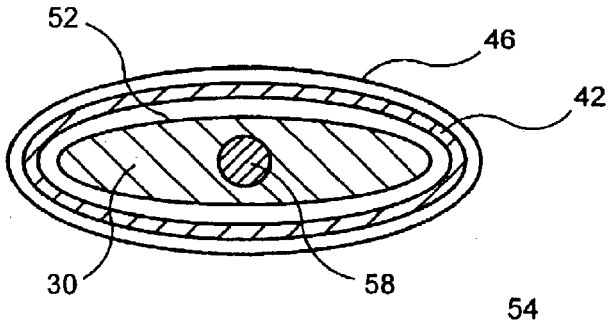
FIG. 9 is a transverse cross-sectional view of the handgrip assembly taken along the line 9—9 in FIG. 8 and locking in the direction of the arrows.
Figure 10:
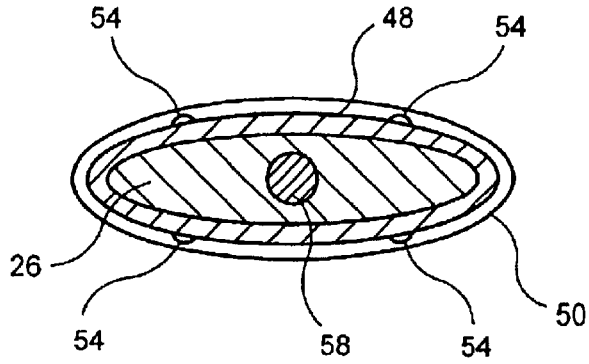
FIG. 10 is a transverse cross-sectional view of the tubular member taken along the line 10—10 in FIG. 8 and locking in the direction of the arrows.

As shown in FIGS. 9 and 10, the base portion 30 of the handgrip assembly 28 and the tubular member 26 preferably have substantially identical elliptical transverse cross sections. The collar 42 and the transition member 48 likewise have correspondingly elliptical cross sections. The major dimensions of the respective elliptical cross sections are oriented in the direction of the axis of rotation of the wheels 22, i.e., perpendicular to the towing direction, and the minor dimensions of the elliptical cross sections are oriented in the towing direction. The elliptical cross-sectional configuration of the tubular member 26, the base portion 30 of the handgrip assembly 28, and the collar assembly 40 and the orientation thereof relative to the towing direction of the luggage facilitates the positioning and locking of the handgrip assembly 28 in the left hand and right hand towing positions. It also allows the collar 42 to be moved easily between the first and second axial positions, and automatically retains it in the first axial position throughout the full rotational movement of the handgrip assembly between the left hand and right hand towing positions. The handgrip assembly 28 will thus be free floating (rotationally) between the 180°-spaced left hand and right hand handgrip towing positions. Although such an "in between" position of the handgrip assembly 28 would not be locked, to resist side-to-side tipping of the luggage, it permits the handgrip portion 32 to be moved to a more ergonomically comfortable orientation for the individual user.

It will be appreciated, of course, that other non-circular cross-sectional configurations could be employed to permit the aforementioned selective rotation and locking of the handgrip assembly 28.

As shown in FIG. 9, the portion of the collar 42 below the flange 46 is spaced slightly from the outer surface 52 of the base portion 30 to allow the collar to slide over the transition member 48. The internal surface of the flanged portion 46 preferably slides snuggly along the base portion 30 to hold the handgrip assembly 28 against rotation when the collar 42 is in the second axial position.

The inner surface of the collar 42 or/and the outer surface of the transition member 48 is/are preferably formed with a locking taper to frictionally retain the collar 42 in exchangement with the transition member 48. Alternatively, one or more raised regions 54 may be formed on the outer surface of the transition member 48 for engagement with the inner surface of the collar 42.

The collar 42 and transition member may be composed of any suitable materials, e.g., a zinc alloy material.

The handle assembly 24 preferably includes a locking mechanism for releasably locking the tubular member in the extended and retracted positions. Suitable locking mechanisms are disclosed in U.S. Pat. Nos. 5,806,143 and 6,357,080, issued Sep. 15, 1998 and Mar. 19, 2002, respectively, to James Tsai, the subject matter of which is hereby incorporated herein by reference for all purposes. The locking mechanism is released to extend or extract the handle assembly 24 by depressing a push-button 56 located on the handgrip portion 32 of the handgrip assembly 28. As disclosed in the '143 and '080 patents, the push-button 56 is normally biased upwardly by the locking mechanism and, upon being depressed, acts through an axially extending rod 58 in the tubular member 26 (FIGS. 9 and 10) to release the locking mechanism. The rod 56 may also serve as a pivot pin about which the handgrip assembly 28 rotates relative to the tubular member 26. The handle assembly 24 may thus be extended or retracted in either rotational position of the handgrip portion 32. Advantageously, the lengthwise locking and unlocking of the tubular member 26 is separate from the rotational locking and unlocking of the handgrip assembly 28, so that the handgrip assembly 28 may be selectively rotated to different towing positions without the unlocking, and possible collapse, of the tubular member 26.

In addition to the left hand and right hand towing positions of the handgrip portion 32, it may also be desirable in certain circumstances for the user to be able to orient the handgrip portion 32 is the towing direction. This may be accomplished in accordance with the embodiment of FIG. 11, which illustrates the handgrip assembly 28 rotated at 90° relative to the tubular member 26. To permit the collar 42 to overlie the rotational dividing line 44 between the tubular member 26 and the base portion 30 of the handgrip assembly 28 when the handgrip assembly 28 is so oriented, a pair of slots 60 are formed in the upper end of the tubular member 26. The slots extending fully through the cross section of the tubular member 26 in the towing direction, i.e., in the direction of the minor dimension of the elliptical cross section of the tubular member, and have a depth in the axial direction of the tubular member 26 sufficient to permit the collar 42 to drop therein and overlie the rotational dividing line 44. With the collar 42 so positioned, the handgrip assembly 28 is rotationally locked with the handgrip portion 32 extending in the towing direction.

Figure 11:
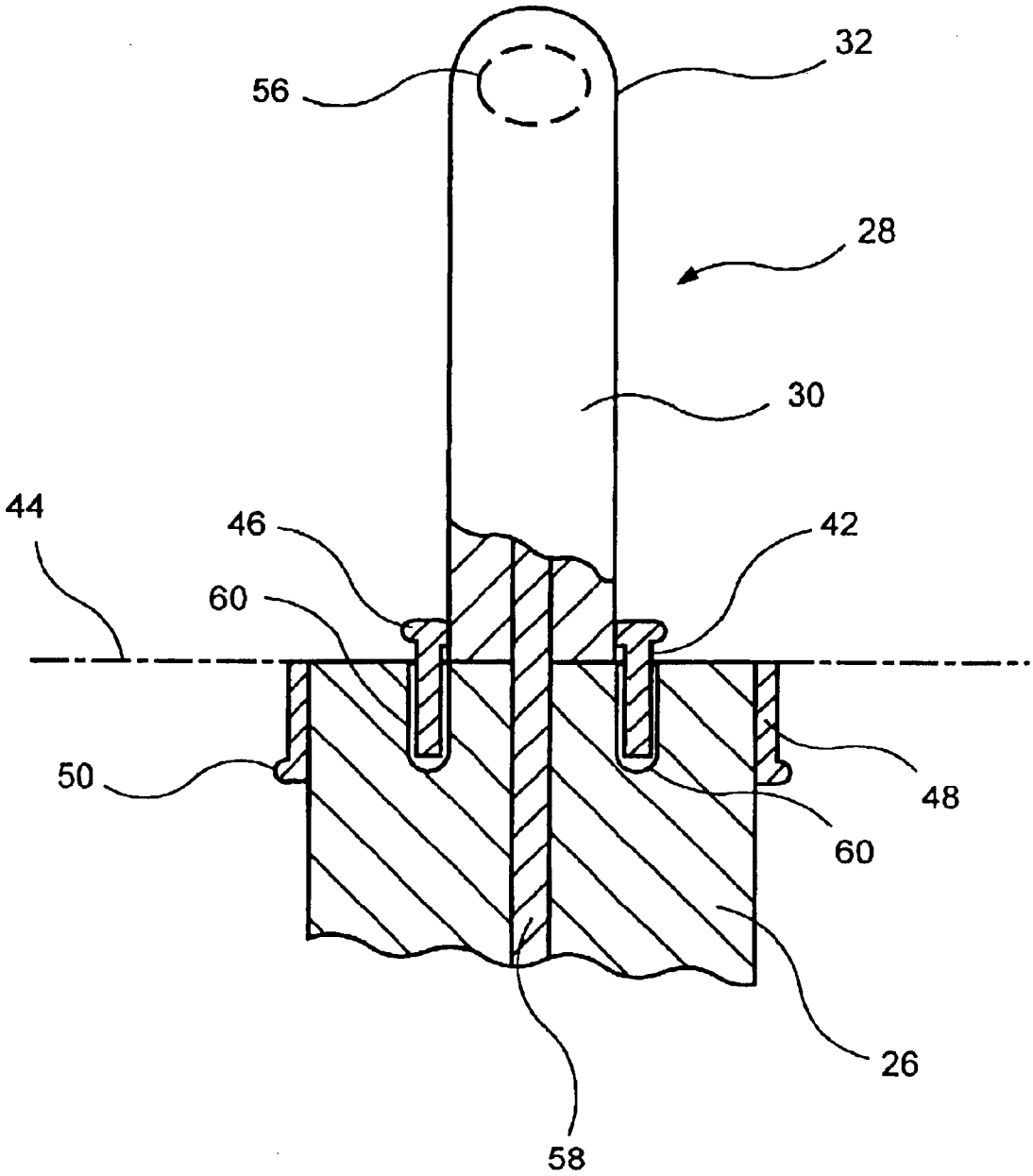
FIG. 11 is a partial cross-sectional view of a second embodiment of the handle assembly in accordance with the invention.

Although the orientation of the handgrip assembly 28 in the embodiment in FIG. 11 results in the luggage being closer to the user's body during towing, it has the advantage of allowing the user's wrist to be aligned and locked in the towing direction. This may reduce the stress on the user's arm, while still resisting side-to-side tipping of the luggage.

Although the invention has been described herein with respect to particular embodiments thereof, it will be understood that such embodiments are susceptible of variation and modification without departing from the inventive concepts disclosed. All such variations and modifications, therefore, are intended to be encompassed within the spirit and scope of the appended claims.

What is claimed is:

1. A handle assembly for towable, wheeled luggage, comprising:

a tubular member having an axis of elongation and being adapted to be connected at one end to a piece of luggage;

a handgrip assembly having a handgrip portion and a base portion, said assembly being mounted on the other end of said tubular member for rotation relative thereto about said axis of elongation, said rotation occurring along a dividing line between said handgrip base portion and the axially adjacent portion of said tubular member; and a collar slidably mounted on said handgrip base portion in surrounding relation thereto for movement in the direction of said of axis of elongation between a first axial position, at which said collar is located on the handgrip assembly side of said dividing line and permits rotation of said handgrip assembly relative to said tubular member, and a second axial position, at which said collar axially overlies said dividing line and prevents rotation of said handgrip assembly relative to said tubular member; wherein:

the base portion of said handle assembly and the axially adjacent portion of said tubular member have substantially the same external transverse cross section;

said collar has an internal transverse cross section corresponding to the external transverse cross sections of said base portion and the axially adjacent portion of said tubular member;

the external transverse cross sections of said base portion and the axially adjacent portion of said tubular member and the internal transverse cross section of said collar are substantially elliptical; and the major dimensions of the elliptical transverse cross sections of the axially adjacent portion said of tubular member and said collar extend substantially perpendicular to the towing direction of the luggage.

2. The handle assembly of claim 1, wherein:

said handgrip portion is eccentric relative to said axis of elongation so as to extend in part transversely beyond the transverse cross section of said tubular member; and by movement of said collar between said first and second axial positions, said handgrip assembly is selectively rotatable to and lockable in a plurality of rotational positions relative to said tubular member.

3. The handle assembly of claim 2, wherein said handgrip assembly has a generally P-shaped configuration, with said base portion forming the stem of the P-shaped configuration and the handgrip portion forming the loop portion of the P-shaped configuration.

4. The handle assembly of claim 1, wherein:

said handgrip portion is eccentric relative to said axis of elongation in the direction of the longer dimension of the elliptical transverse cross section of said base member; and by movement of said collar between said first and second axial positions, said handgrip assembly is selectively rotatable to and lockable in a first rotational position relative to said tubular member, at which said eccentric handgrip portion extends to one side of said tubular member in a direction substantially perpendicular to the towing direction, and a second rotational position relative to said tubular member, at which said eccentric tubular member is rotated 180° relative to said first rotational position and extends to the other side of said tubular member in a direction substantial perpendicular to the towing direction.

5. The handle assembly of claim 4, wherein said handgrip assembly has a generally P-shaped configuration, with the base portion forming the stem of the P-shaped configuration and the handgrip portion forming the loop portion of the P-shaped configuration.

6. The handle assembly of claim 4, further comprising a pair of axially extending slots in the upper end of the axially adjacent portion of said tubular member, said slots extending through the upper end of said axially adjacent portion in the direction of the minor dimension of the transverse cross section thereof and being spaced apart in the direction of the major dimension of the transverse cross section thereof by a distance such that said collar, when rotated through 90° from said first or second rotational position and moved to said second axial position, is axially received within said slots to lock said handgrip assembly in a rotational position with said eccentric handgrip portion extending substantially in the towing direction.

7. The handle assembly of claim 1, wherein said collar is comprised of zinc or a zinc alloy.

8. The handle assembly of claim 1, further comprising a transition member mounted on the upper end of the axially adjacent portion of said tubular member, said collar when in said second axial position extending axially over at least a portion of said transition member.

9. The handle assembly of claim 8, further comprising means for retaining said collar in frictional engagement with said transition member when said collar is in said second axial position.

10. The handle assembly of claim 9, wherein said frictional retaining means comprises a locking taper formed on at least one of the internal surface of said collar or the external surface of said transition member.

11. The handle assembly of claim 1, wherein said collar has a circumferential flange at the axially upper end thereof, said flange forming a finger grip for facilitating movement of said collar between said first and second axial positions.

12. The handle assembly of claim 1, wherein:

said tubular member comprises a telescopically extendable and retractable member; and said handgrip assembly further comprises a push button for operating a locking mechanism for control of the extension and retraction of said tubular member.

13. A handle assembly for towable, wheeled luggage, comprising:

a tubular member having an axis of elongation and being adapted to be connected at one end to a piece of luggage;

a handgrip assembly having a handgrip portion and a base portion, said assembly being mounted on the other end of said tubular member for rotation relative thereto about said axis of elongation, said rotation occurring along a dividing line between said handgrip base portion and the axially adjacent portion of said tubular member;

a collar slidably mounted on said handgrip base portion in surrounding relation thereto for movement in the direction of said of axis of elongation between a first axial position, at which said collar is located on the handgrip assembly side of said dividing line and permits rotation of said handgrip assembly relative to said tubular member, and a second axial position, at which said collar axially overlies said dividing line and prevents rotation of said handgrip assembly relative to said tubular member;

a transition member mounted on the upper end of the axially adjacent portion of said tubular member, said collar when in said second axial position extending axially over at least a portion of said transition member; and means for retaining said collar in frictional engagement with said transition member when said collar is in said second axial position;

wherein said frictional retaining means comprises one or more raised portions on at least one of the internal surface of said collar or on the external surface of said transition member.

* * * * *

UNITED STATES PATENT AND TRADEMARK OFFICE

CERTIFICATE OF CORRECTION

PATENT NO. : 6,857,512 B2
DATED : February 22, 2005
INVENTOR(S) : Scicluna et al.

It is certified that error appears in the above-identified patent and that said Letters Patent is hereby corrected as shown below:

Column 6,
Line 56, "axially adjacent portion said of" should read -- axially adjacent portion of said --

Signed and Sealed this

Twenty-eighth Day of June, 2005

JON W. DUDAS
*Director of the United States Patent and Trademark Office*